US009668047B2

(12) United States Patent
Park et al.

(10) Patent No.: US 9,668,047 B2
(45) Date of Patent: May 30, 2017

(54) MICROPHONE

(71) Applicant: Hyundai Motor Company, Seoul (KR)

(72) Inventors: Sang Gyu Park, Seoul (KR); Sang Hyeok Yang, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/957,287

(22) Filed: Dec. 2, 2015

(65) Prior Publication Data

US 2017/0064443 A1 Mar. 2, 2017

(30) Foreign Application Priority Data

Aug. 28, 2015 (KR) ..... 10-2015-0121846

(51) Int. Cl.

| | |
|---|---|
| ***H04R 25/00*** | (2006.01) |
| ***H04R 3/00*** | (2006.01) |
| ***H04R 1/04*** | (2006.01) |
| ***H04R 29/00*** | (2006.01) |
| ***H04R 19/04*** | (2006.01) |

(52) U.S. Cl.

CPC ..... *H04R 3/005* (2013.01); *H04R 1/04* (2013.01); *H04R 19/04* (2013.01); *H04R 29/004* (2013.01); *H04R 29/006* (2013.01); *H04R 2201/403* (2013.01); *H04R 2410/05* (2013.01)

(58) Field of Classification Search

CPC ..... H04R 1/1083; H04R 3/02; H04R 3/005; H04R 19/005; H04R 19/016; H04R 19/04; H04R 29/006; H04R 2201/003; H04R 2201/107; H04R 2201/403; H04R 1/04; H04R 5/027; H04R 29/004; H04R 2410/05

USPC ..... 381/71.1, 71.6, 72, 92, 94.1, 355, 361, 381/174, 175, 191; 379/392.01

See application file for complete search history.

(56) References Cited

U.S. PATENT DOCUMENTS

| | | | | |
|---|---|---|---|---|
| 5,381,473 A * | 1/1995 | Andrea | ..... | H04M 1/05 379/388.03 |
| 5,673,325 A * | 9/1997 | Andrea | ..... | H04M 1/05 379/392.01 |
| 5,732,143 A | 3/1998 | Andrea et al. | | |
| 2006/0145570 A1 * | 7/2006 | Ohbayashi | ..... | H04R 19/005 310/322 |

(Continued)

FOREIGN PATENT DOCUMENTS

| | | |
|---|---|---|
| JP | 5108533 B2 | 12/2012 |
| KR | 10-1999-0022727 | 3/1999 |

(Continued)

*Primary Examiner* — Huyen D Le

(74) *Attorney, Agent, or Firm* — Brinks Gilson & Lione

(57) ABSTRACT

The present disclosure relates to a microphone, and more particularly, to a microphone capable of improving a signal-to-noise ratio (SNR) by receiving a sound pressure through at least two acoustic sensing modules.

According to an exemplary form of the present disclosure, a microphone includes first and second acoustic sensing modules including a diaphragm vibrated by a sound pressure introduced from the outside and a fixed membrane spaced apart from the diaphragm, and a signal processing module receiving first and second capacitance signals from each of the first and second acoustic sensing modules and removing and outputting noises included in the first and second capacitance signals based on the first and second capacitance signals.

3 Claims, 4 Drawing Sheets

(56) References Cited

U.S. PATENT DOCUMENTS

| | | | | |
|---|---|---|---|---|
| 2011/0075865 | A1 | 3/2011 | Yang et al. | |
| 2012/0051575 | A1* | 3/2012 | Akino | H04R 1/04 381/355 |
| 2012/0269367 | A1* | 10/2012 | Akino | H04R 29/006 381/174 |
| 2015/0063608 | A1* | 3/2015 | Schelling | H04R 19/005 381/174 |

FOREIGN PATENT DOCUMENTS

| | | | |
|---|---|---|---|
| KR | 10-2011-0025697 | A | 3/2011 |
| KR | 10-1109097 | B1 | 1/2012 |
| KR | 10-2012-0054244 | A | 5/2012 |
| KR | 10-2012-0139744 | A | 12/2012 |
| KR | 10-2013-0044576 | A | 5/2013 |
| KR | 10-1293056 | B1 | 8/2013 |
| KR | 10-2014-0036790 | A | 3/2014 |
| KR | 10-2014-0135349 | A | 11/2014 |
| WO | WO 97/25790 | | 7/1997 |

* cited by examiner

MICROPHONE

CROSS-REFERENCE TO RELATED APPLICATION

This application claims priority to Korean Patent Application No. 10-2015-0121846, filed on Aug. 28, 2015, the entire contents of which is incorporated herein by reference.

FIELD

The present disclosure relates to a microphone, and more particularly, to a microphone capable of improving a signal-to-noise ratio (SNR) by receiving a sound pressure through at least two acoustic sensing modules.

BACKGROUND

A microphone which has been widely used in mobile devices, acoustic devices, vehicles, or the like senses a sound, that is, a sound wave, and converts the sound into a physical value or an electrical value. The converted signal is processed to be a signal which may be captured by a person or a machine.

Since the microphone receives a natural signal such as the sound wave, analog signal processing is essentially performed for signal conversion. Performance of a circuit for processing an analog signal may directly affect the overall performance of the microphone. In particular, the microphone receives a wide frequency range of a signal due to its characteristics and therefore noise characteristics are very important.

The microphone has a thin film applied with a pressure due to the sound pressure and thus an interval between two electrodes is changed. As a result, since capacitance is changed, the microphone converts a change amount of the capacitance into a voltage output using a buffer and outputs a digital signal. The typical microphone receives a single input signal and therefore outputs power supply noise and noise included in a bias voltage through the buffer as they are, such that sensitivity of the microphone may deteriorate. As a result, a high sensitivity microphone may show inappropriate performance.

Further, a signal-to-noise ratio (SNR) of the existing microphone applied to a vehicle is not good, such that customer dissatisfaction with a speech recognition rate or handsfree performance has been raised.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a microphone capable of processing a signal by receiving a sound pressure through at least two acoustic sensing modules.

Further, the present disclosure has been made in an effort to provide a microphone capable of increasing an output signal and improving a signal-to-noise ratio.

An exemplary form of the present disclosure provides a microphone including: first and second acoustic sensing modules including a diaphragm vibrated by a sound pressure introduced from the outside and a fixed membrane spaced apart from the diaphragm, and a signal processing module receiving first and second capacitance signals from each of the first and second acoustic sensing modules and removing and outputting noises included in the first and second capacitance signals based on the first and second capacitance signals.

The signal processing module may include an amplifier amplifying the first and second capacitance signals and removing the noises included in the first and second capacitance signals to output an output signal.

The amplifier may include: a non-inverting input terminal connected to the first acoustic sensing module and receiving the first capacitance signal including noise from the first acoustic sensing module, an inverting input terminal connected to the second acoustic sensing module and receiving the second capacitance signal including noise from the second acoustic sensing module, and an output terminal removing the noises included in the first and second capacitance signals and amplifying the first and second capacitance signals to output an output signal.

Each of the first and second capacitance signals may be determined by at least one of sensitivities and capacitances of the first and second acoustic sensing modules, a sound pressure, noise, and a bias.

The sensitivity of the first acoustic sensing module and the sensitivity of the second acoustic sensing module may be equal to each other, and the capacitance of the first acoustic sensing module and the capacitance of the second acoustic sensing module may be equal to each other.

The output signal may be generated by performing a subtraction operation on the first capacitance signal and the second capacitance signal.

Another form of the present disclosure provides a microphone, including: first and second acoustic sensing modules outputting first and second capacitance signals for capacitance changed by a sound pressure introduced from the outside, and a signal processing module receiving the first and second capacitance signals from each of the first and second acoustic sensing modules and including an amplifier amplifying the first and second capacitance signals to output an output signal, in which the amplifier may include a non-inverting input terminal electrically connected to the first acoustic sensing module and receiving the first capacitance signal from the first acoustic sensing module, an inverting input terminal electrically connected to the second acoustic sensing module and receiving the second capacitance signal from the second acoustic sensing module, and an output terminal removing the noises included in the first and second capacitance signals and amplifying and outputting the first and second capacitance signals from which the noises are removed.

According to a form of the present disclosure, it is possible to remove the noise introduced from the outside by receiving the sound pressure through the at least two acoustic sensing modules.

Further, according to a form of the present disclosure, it is possible to improving the speech recognition rate or the handsfree performance by increasing the output signal and improving the signal-to-noise ratio.

Further, the effects which may be obtained or predicted by the exemplary form of the present disclosure will be directly or implicitly disclosed in the detailed description of the exemplary forms of the present disclosure. That is, various effects which are predicted by the exemplary forms of the present disclosure will be disclosed in the detailed description to be described below.

DRAWINGS

DETAILED DESCRIPTION

Hereinafter, an operation principle of a microphone according to an exemplary form of the present disclosure will be described with reference to the accompanying drawings. However, the following illustrated drawings and the detailed description to be described below relate to one exemplary form among several exemplary forms for effectively describing features of the present disclosure. Therefore, the present disclosure is not limited to only the following drawings and the description.

In describing exemplary forms of the present disclosure, well-known functions or constructions will not be described in detail since they may unnecessarily obscure the understanding of the present disclosure. Further, the following terminologies are defined in consideration of the functions in the present disclosure, and may be construed in different ways by the intention of users and operators or practice. Therefore, the definitions thereof should be construed based on the contents throughout the specification.

Further, for efficiently describing the technical core features of the present disclosure, terms will be appropriately changed, integrated, or separately used in the following exemplary forms to be clearly understood by those skilled in the art, but the present disclosure is never limited thereto.

Hereinafter, an exemplary form of the present disclosure will be described in detail with reference to the accompanying drawings.

Figure 1:
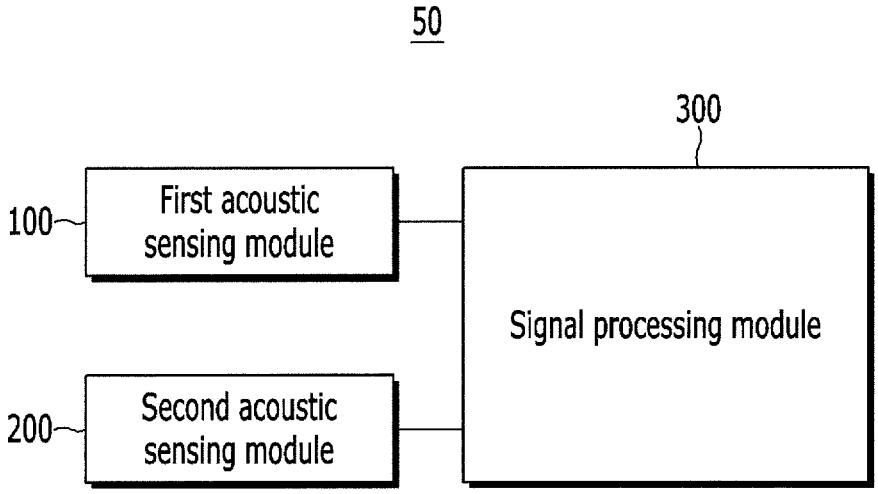
FIG. 1 is a diagram schematically illustrating a microphone.

FIG. 1 is a diagram schematically illustrating a microphone.

Referring to FIG. 1, a microphone 50 includes a first acoustic sensing module 100, a second acoustic sensing module 200, and a signal processing module 300.

The first acoustic sensing module 100 and the second acoustic sensing module 200 are vibrated by a sound pressure depending on an acoustic signal input from the outside to generate an electrical signal.

The first acoustic sensing module 100 and the second acoustic sensing module 200 may be an acoustic sensing module using a microelectromechanical systems (MEMS) technology.

The first acoustic sensing module 100 and the second acoustic sensing module 200 include a fixed membrane 160 and a diaphragm 130 which form a capacitor. When the sound pressure depending on the acoustic signal is applied to the diaphragm 130 from the outside, an interval between the fixed membrane 160 and the diaphragm 130 is changed and capacitance of the capacitor is changed correspondingly. In this case, the first acoustic sensing module 100 and the second acoustic sensing module 200 output a varying capacitance signal to the signal processing module 300.

A structure of the first acoustic sensing module 100 will be described with reference to FIG. 2.

The signal processing module 300 is connected to the first acoustic sensing module 100 and the second acoustic sensing module 200. The signal processing module 300 receives a first capacitance signal from the first acoustic sensing module 100 and receives a second capacitance signal from the second acoustic sensing module 200. The signal processing module 300 amplifies and outputs the first capacitance signal and the second capacitance signal and therefore may sense the sound pressure from the outside.

The signal processing module 300 may be an application specific integrated circuit (ASIC).

The signal processing module 300 will be described in more detail with reference to FIG. 3.

Figure 2:
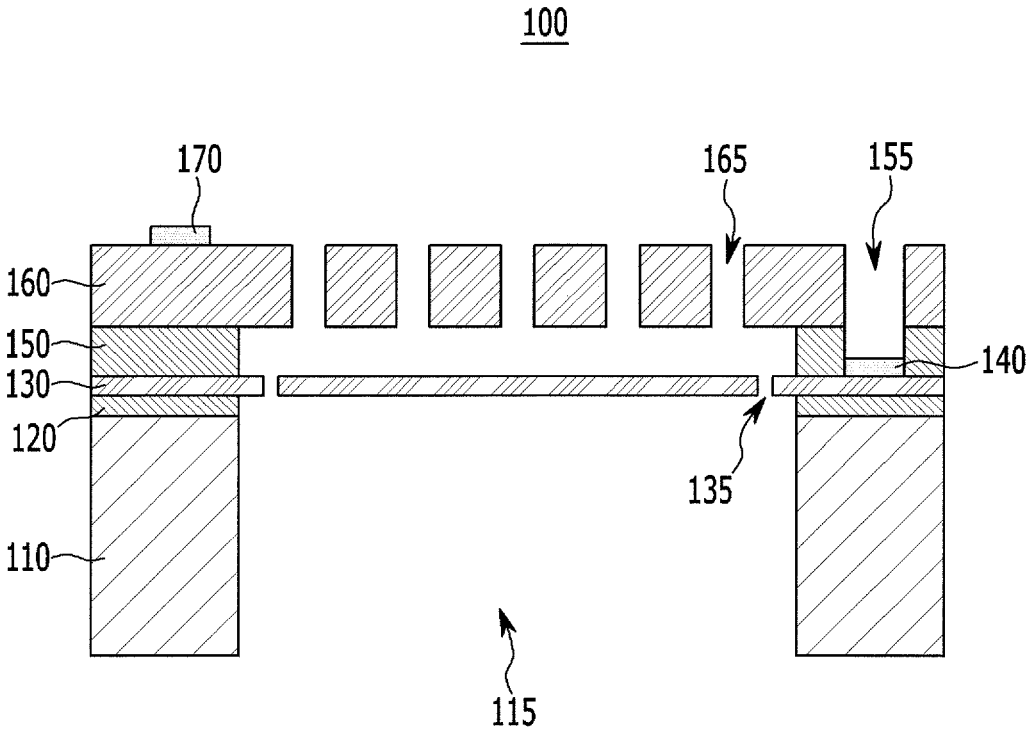
FIG. 2 is a diagram illustrating a first acoustic sensing module.

FIG. 2 is a diagram illustrating a first acoustic sensing module.

Referring to FIG. 2, the first acoustic sensing module 100 includes a substrate 110, the diaphragm 130, and the fixed membrane 160.

The substrate 110 may be made of silicon and is provided with a through hole 115.

An oxide film 120 is disposed on the substrate 110. That is, the oxide film 120 may be disposed between the substrate 110 and the diaphragm 130.

The diaphragm 130 is disposed on the oxide film 120 and covers the through hole 115 formed on the substrate 110. A portion of the diaphragm 130 is exposed through the through hole 115, and the portion of the diaphragm 130 exposed through the through hole 115 is vibrated by the sound pressure introduced from the outside.

The diaphragm 130 may have a circular shape and includes a plurality of slots 135. The slot 135 is disposed on the through hole 115.

A first pad 140 is disposed on the diaphragm 130. The first pad 140 is connected to the signal processing module 300.

A support layer 150 is disposed at an edge portion of the diaphragm 130 and supports the fixed membrane 160. The support layer 150 is provided with a contact hole 155 for exposing the first pad 140.

The fixed membrane 160 is spaced apart from the diaphragm 130. The fixed membrane 160 includes a plurality of air inlets 165. The fixed membrane 160 is fixedly disposed on the support layer 150. Here, the fixed membrane 160 may be made of polysilicon or metal.

An air layer is formed between the fixed membrane 160 and the diaphragm 130. The fixed membrane 160 and the diaphragm 130 are spaced apart from each other at a predetermined distance. The sound pressure is introduced through the air inlet 165 formed on the fixed membrane 160 to stimulate the diaphragm 130, such that the diaphragm 130 is vibrated. In this case, the interval between the fixed membrane 160 and the diaphragm 130 is changed and the capacitance between the diaphragm 130 and the fixed membrane 160 is changed correspondingly. The so-changed capacitance signal is output to the signal processing module 300 through the first pad 140 connected to the diaphragm 130 and a second pad 170 connected to the fixed membrane 160.

The second pad 170 is disposed on the fixed membrane 160. The second pad 170 is connected to the signal processing module 300.

Meanwhile, a structure of the second acoustic sensing module 200 is the same as that of the first acoustic sensing module 100 described in FIG. 2, and therefore a description thereof will be omitted.

Figure 3:
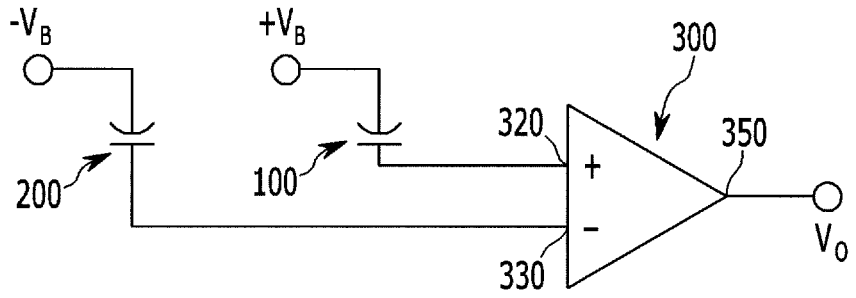
FIG. 3 is a circuit diagram illustrating the microphone.

FIG. 3 is a circuit diagram illustrating the microphone.

Referring to FIG. 3, the signal processing module 300 may be an amplifier 300 amplifying and outputting the first and second capacitance signals input from the first acoustic sensing module 100 and the second acoustic sensing module 200.

The amplifier 300 includes a non-inverting input terminal 320, an inverting input terminal 330, and an output terminal 350.

The non-inverting input terminal 320 is connected to the first acoustic sensing module 100 and receives the first capacitance signal from the first acoustic sensing module 100.

The first capacitance signal may be determined by at least one of sensitivity of the first acoustic sensing module 100, capacitance of the first acoustic sensing module 100, a sound pressure, noise, and a bias. In this case, the noise may be noise generated from the outside.

That is, the first capacitance signal may be determined by the following Equation 1.

$$\Delta V_1 = -k_1 C_1 (V_B + V_N) \Delta P_S \quad \text{[Equation 1]}$$

In the above Equation 1, $\Delta V_1$ represents the first capacitance signal, $k_1$ represents a sensitivity constant of the first acoustic sensing module 100, $C_1$ represents the capacitance of the first acoustic sensing module 100, $V_N$ represents the noise, $V_B$ represents the bias, and $\Delta P_S$ represents the sound pressure.

The inverting input terminal 330 is connected to the second acoustic sensing module 200 and receives the second capacitance signal from the second acoustic sensing module 200.

The second capacitance signal may be determined by at least one of sensitivity of the second acoustic sensing module 200, the capacitance of the second acoustic sensing module, a sound pressure, noise, and a bias.

That is, the second capacitance signal may be determined by the following Equation 2.

$$\Delta V_2 = -k_2 C_2 (-V_B + V_N) \Delta P_S \quad \text{[Equation 2]}$$

In the above Equation 2, $\Delta V_2$ represents the second capacitance signal, $k_2$ represents a sensitivity constant of the second acoustic sensing module 200, $C_2$ represents the capacitance of the second acoustic sensing module 200, $V_B$ represents the bias, $V_N$ represents the noise, and $\Delta P_S$ represents the sound pressure.

The first capacitance signal and the second capacitance signal may include noise as can be confirmed by the above Equations 1 and 2.

The output terminal 350 removes the noises included in the first capacitance signal and the second capacitance signal, and amplifies the first capacitance signal and the second capacitance signal without noise to output an output signal.

The output signal may be determined by the following Equation 3.

$$V_0 = \Delta V_1 - \Delta V_2 \quad \text{[Equation 3]}$$

In the above Equation 3, $V_O$ may represent the output signal, $\Delta V_1$ may represent the first capacitance signal, and $\Delta V_2$ may represent the second capacitance signal.

In this case, the first acoustic sensing module 100 and the second acoustic sensing module 200 use the same acoustic sensing module, and therefore the capacitance of the first acoustic sensing module 100 may be equal to that of the second acoustic sensing module 200 and the sensitivity of the first acoustic sensing module 100 may be equal to that of the second acoustic sensing module 200.

Therefore, the output signal may be determined by the following Equation 4.

$$V_0 = -2kC_0 V_B \Delta P_S \quad \text{[Equation 4]}$$

In the above Equation 4, $V_O$ may represent the output signal, k may represent an initial sensitivity constant, $C_0$ may represent an initial capacitance, $V_B$ may represent the bias, and $\Delta P_S$ may represent the sound pressure.

Therefore, the signal processing module 300 may remove noise and output the amplified output signal as can be confirmed by the above Equation 4.

Figure 4:
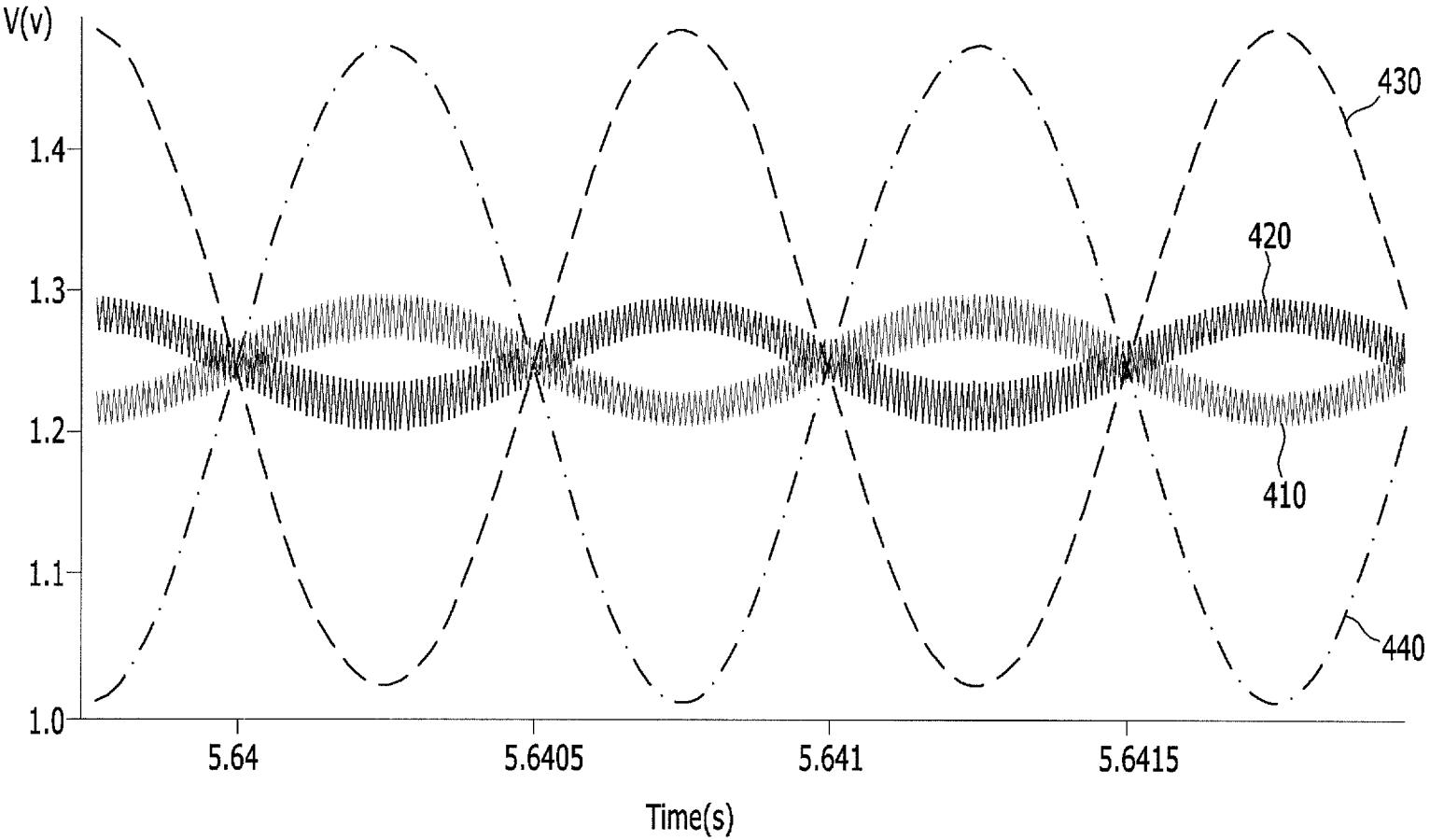
FIG. 4 is a diagram illustrating a simulation result of the microphone.

FIG. 4 is a diagram illustrating a simulation result of the microphone 50.

Referring to FIG. 4, the signal processing module 300 receives a first capacitance signal 410 including noise from the first acoustic sensing module 100, and receives a second capacitance signal 420 from the second acoustic sensing module 200 including noise. The signal processing module 300 may remove noises from the first capacitance signal 410 and the second capacitance signal 420 and amplify the signals without noises to output output signals 430 and 440.

While this disclosure has been described in connection with what is presently considered to be practical exemplary forms, it is to be understood that the disclosure is not limited to the disclosed forms, but, on the contrary, is intended to cover various modifications and equivalent arrangements included within the spirit and scope of the appended claims.

What is claimed is:

1. A microphone, comprising:

a first acoustic sensing module including a first diaphragm configured to vibrate based on sound pressure introduced from outside the microphone and a first fixed membrane spaced apart from the first diaphragm;

a second acoustic sensing module including a second diaphragm configured to vibrate based on sound pressure introduced from outside the microphone and a second fixed membrane spaced apart from the second diaphragm; and a signal processing module configured to receive a first capacitance signal and a second capacitance signal from the first acoustic sensing module and the second acoustic sensing module, respectively, wherein the signal processing module includes an amplifier, and the amplifier comprises:

a non-inverting input terminal coupled to the first acoustic sensing module, wherein the non-inverting input terminal is configured to receive the first capacitance signal, including noise, from the first acoustic sensing module;

an inverting input terminal coupled to the second acoustic sensing module, wherein the inverting input terminal is configured to receive the second capacitance signal, including noise, from the second acoustic sensing module; and an output terminal configured to remove the noise included in the first capacitance signal, remove the noise included in the second capacitance signal, amplify the first capacitance signal to an amplified first capacitance signal, amplify the second capacitance signal to an amplified second capacitance signal, output an output signal based on the amplified first capacitance signal and the amplified second capacitance signal;

wherein the first capacitance signal and the second capacitance signal are determined by sensitivities and capacitances of the first acoustic sensing module and the second acoustic sensing module, a sound pressure, a noise, and a bias.

2. The microphone of claim 1, wherein the sensitivity of the first acoustic sensing module and the sensitivity of the second acoustic sensing module are equal to each other, and the capacitance of the first acoustic sensing module and the capacitance of the second acoustic sensing module are equal to each other.

3. The microphone of claim 1, wherein the output signal is generated by performing a subtraction operation on the amplified first capacitance signal and the amplified second capacitance signal.

* * * * *